US011269296B2

(12) United States Patent
Oikawa

(10) Patent No.: US 11,269,296 B2
(45) Date of Patent: Mar. 8, 2022

(54) ELECTRONIC TIMEPIECE, CONTROL METHOD, AND NON-TRANSITORY RECORDING MEDIUM

(71) Applicant: CASIO COMPUTER CO., LTD., Tokyo (JP)

(72) Inventor: Shuto Oikawa, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 752 days.

(21) Appl. No.: 16/142,055

(22) Filed: Sep. 26, 2018

(65) Prior Publication Data

US 2019/0094814 A1 Mar. 28, 2019

(30) Foreign Application Priority Data

Sep. 27, 2017 (JP) ..... JP2017-186896

(51) Int. Cl.
*G04G 21/04* (2013.01)
*G04G 5/00* (2013.01)
(Continued)

(52) U.S. Cl.
CPC ..... *G04G 5/002* (2013.01); *G04G 7/02* (2013.01); *G04G 9/0076* (2013.01); *G04G 21/04* (2013.01);
(Continued)

(58) Field of Classification Search
CPC ..... G04R 20/04; G04R 20/26; G04G 5/00; G04G 5/002; G04G 7/02; G04G 9/0076; G04G 21/04; G04G 99/006
See application file for complete search history.

(56) References Cited

U.S. PATENT DOCUMENTS 8,300,687 B1 * 10/2012 Eliezer ..... G04R 20/10 375/238
8,937,851 B2 * 1/2015 Matsuo ..... G04R 20/12 368/47
(Continued)

FOREIGN PATENT DOCUMENTS

JP 2011-252931 A 12/2011
JP 2016-024018 A 2/2016

OTHER PUBLICATIONS

Extended European Search Report dated Feb. 28, 2019 received in European Patent Application No. EP 18196962.7.
(Continued)

*Primary Examiner* — Sean Kayes
(74) *Attorney, Agent, or Firm* — Scully Scott Murphy & Presser

(57) ABSTRACT

An electronic timepiece includes a storage that stores specific-region DST application rule information and local time information that includes, in association with each other, DST application rules for each region and standard-wave transmitting station information indicating each station transmitting standard waves receivable in the region; a processor that controls clock time to be kept by a clock circuit and displays time to be displayed on a display; and a standard wave receiver that receives standard waves and obtains time information. The processor calibrates the clock time based on the time information indicated by the standard waves received by the standard wave receiver, and controls the display time based on whether the specific-region DST application rule information and the DST application rule information associated with the standard-wave transmitting station information indicating a station transmitting the received standard waves satisfy a predetermined condition.

7 Claims, 3 Drawing Sheets

(51) Int. Cl.

| | |
|---|---|
| ***G04G 9/00*** | (2006.01) |
| ***G04R 20/04*** | (2013.01) |
| ***G04G 99/00*** | (2010.01) |
| ***G04G 7/00*** | (2006.01) |
| ***G04R 20/26*** | (2013.01) |

(52) U.S. Cl.
CPC ..... *G04G 99/006* (2013.01); *G04R 20/04* (2013.01); *G04R 20/26* (2013.01)

(56) References Cited

U.S. PATENT DOCUMENTS

| | | | | |
|---|---|---|---|---|
| 9,696,689 | B2 * | 7/2017 | Hasegawa ..... | G04R 20/02 |
| 2005/0202796 | A1 * | 9/2005 | Haefner ..... | G04R 20/10 455/265 |
| 2009/0296530 | A1 | 12/2009 | Ozawa | |
| 2013/0077448 | A1 | 3/2013 | Matsuo et al. | |
| 2016/0018792 | A1 | 1/2016 | Hasegawa | |

OTHER PUBLICATIONS

Notice of Reasons for Refusal dated Jun. 9, 2020 received in Japanese Patent Application No. JP 2017-186896 together with an English language translation.

* cited by examiner

FIG. 2

LOCAL TIME INFORMATION TABLE

| CITY NUM-BER | CITY | TIME DIFFE-RENCE | TIME ZONE | DST APPLICATION RULES | | | STANDARD WAVE TRANSMITTING STATION |
|---|---|---|---|---|---|---|---|
| | | | | INITIATION DATE AND TIME | TERMINATION DATE AND TIME | SHIFTED TIME | |
| 1 | LONDON | 0.0 | *** | LAST SUNDAY OF MARCH 1:00 AM | LAST SUNDAY OF OCTOBER 2:00 AM | 1.0 | MSF60/DCF77.5 |
| 2 | PARIS | 1.0 | *** | LAST SUNDAY OF MARCH 2:00 AM | LAST SUNDAY OF OCTOBER 3:00 AM | 1.0 | MSF60/DCF77.5 |
| 3 | TEHRAN | 3.5 | *** | MARCH 22 OR MARCH 21 0:00 AM | SEPTEMBER 22 OR SEPTEMBER 21 0:00 AM | 1.0 | — |
| 4 | HONG KONG | 8.0 | *** | — | — | — | BPC |
| 5 | TOKYO | 9.0 | *** | — | — | — | JJY40/60 |
| 6 | SYDNEY | 9.5 | *** | FIRST SUNDAY OF OCTOBER 2:00 AM | FIRST SUNDAY OF APRIL 2:00 AM | 1.0 | — |
| 7 | LOS ANGELS | −8.0 | *** | SECOND SUNDAY OF MARCH 2:00 AM | FIRST SUNDAY OF NOVEMBER 2:00 AM | 1.0 | WWVB60 |
| 8 | NEW YORK | −5.0 | *** | SECOND SUNDAY OF MARCH 2:00 AM | FIRST SUNDAY OF NOVEMBER 2:00 AM | 1.0 | WWVB60 |
| 9 | RIO DE JANEIRO | −3.0 | *** | LAST SUNDAY OF MARCH 3:00 AM | LAST SUNDAY OF OCTOBER 4:00 AM | 1.0 | — |

ELECTRONIC TIMEPIECE, CONTROL METHOD, AND NON-TRANSITORY RECORDING MEDIUM

CROSS-REFERENCE TO RELATED APPLICATION

This application claims the benefit of Japanese Patent Application No. 2017-186896, filed on Sep. 27, 2017, the entire disclosure of which is incorporated by reference herein.

FIELD

This application relates to an electronic timepiece, a control method, and a non-transitory recording medium.

BACKGROUND

Electronic timepieces are known that receive standard waves to obtain time information and daylight-saving-time (DST) application information and that calibrate time based on appropriate application of daylight saving time. For example, Unexamined Japanese Patent Application Kokai Publication No. 2011-252931, which is a Japanese patent literature, discloses a radio timepiece that independently determines a DST period of application of daylight saving time and determines time in accordance with the determined DST period.

Such an electronic timepiece that complies with the independently determined rules for application of daylight saving time regardless of DST application information indicated by standard waves, however, may fail to provide a user with time based on appropriate application of daylight saving time.

SUMMARY

This application discloses an electronic timepiece, a control method, and a non-transitory recording medium.

An electronic timepiece according to a preferred embodiment includes a storage that stores local time information and specific-region DST application rule information, a clock circuit that keeps time, a display that displays time; a processor that controls clock time to be kept by the clock circuit and displays time to be displayed on the display, and a standard wave receiver that receives standard waves and obtains time information. The local time information includes DST application rule information for each region and standard-wave transmitting station information in association with each other. The standard-wave transmitting station information indicates each station transmitting the standard waves receivable in the region. The specific-region DST application rule information indicates DST application rules for a specific region. The processor calibrates the clock time based on the time information indicated by the standard waves received by the standard wave receiver, and controls the display time based on whether the DST application rule information and the specific-region DST application rule information satisfy a predetermined condition. This DST application rule information is associated with the standard-wave transmitting station information in the local time information and the standard-wave transmitting station information indicates a station transmitting the standard waves received by the standard wave receiver.

BRIEF DESCRIPTION OF THE DRAWINGS

A more complete understanding of this application can be obtained when the following detailed description is considered in conjunction with the following drawings, in which:

FIG. 2 illustrates an exemplary local time information table; and

DETAILED DESCRIPTION

An electronic timepiece according to an embodiment will now be described in detail with reference to the accompanying drawings.

An electronic timepiece 100 receives standard waves in the long wavelength region (low-frequency band) transmitted from standard wave transmitting stations and satellite waves transmitted from navigation satellites, and calibrates the time determined inside the electronic timepiece 100 based on the obtained time information. The electronic timepiece 100 appropriately implements daylight-saving-time (DST) application rules to the display time in accordance with the setting of the display time.

Figure 1:
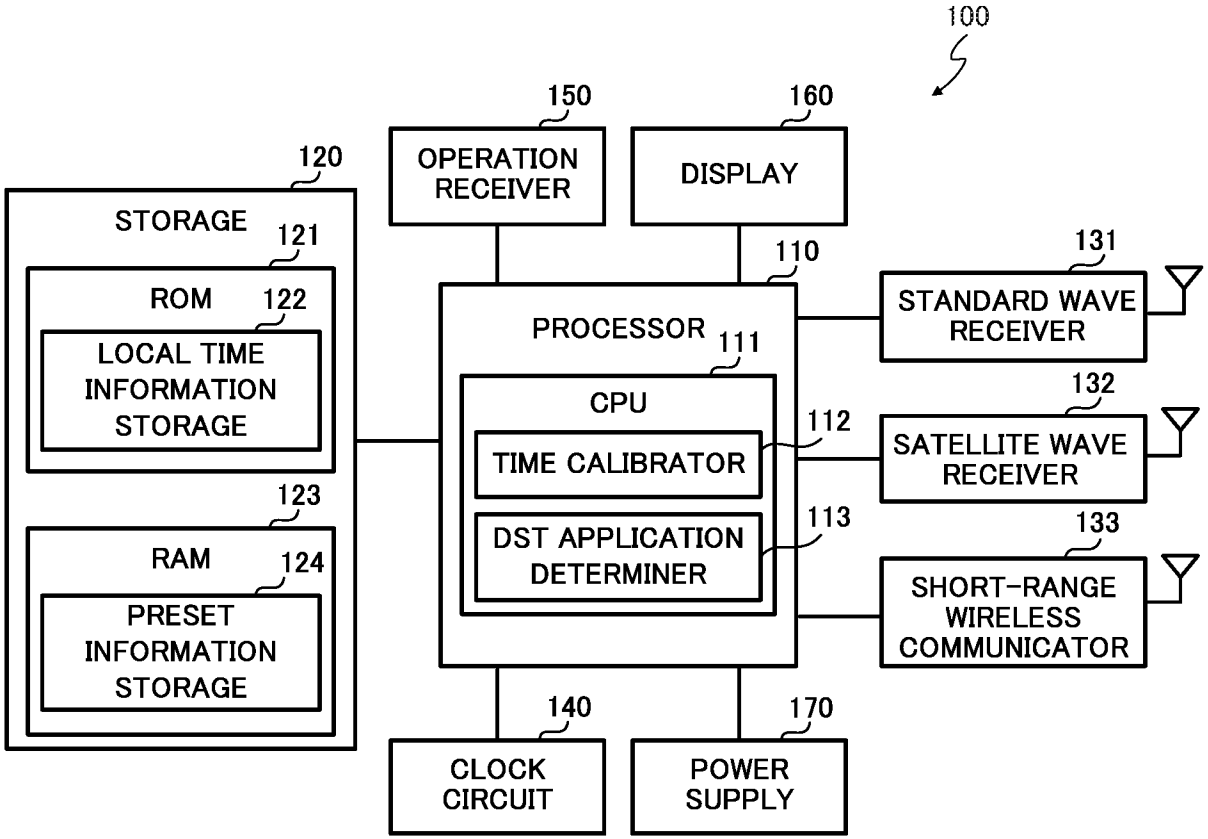
FIG. 1 illustrates the configuration of an electronic timepiece according to an embodiment of the disclosure.

With reference to FIG. 1, the electronic timepiece 100 includes a processor 110, a storage 120, a standard wave receiver 131, a satellite wave receiver 132, a short-range wireless communicator 133, a clock circuit 140, an operation receiver 150, a display 160, and a power supply 170.

The processor 110 includes a central processing unit (CPU) 111. The processor 110 reads various operational programs stored in a read-only memory (ROM) 121 of the storage 120 and executes the programs on a random access memory (RAM) 123, thereby controlling the overall operations of the electronic timepiece 100.

The CPU 111 functions as a time calibrator 112 and a DST application determiner 113. The individual functions of the time calibrator 112 and the DST application determiner 113 may be performed by a single CPU or separate CPUs.

The time calibrator 112 calibrates the time determined by the clock circuit 140 based on the time information input from the standard wave receiver 131, the satellite wave receiver 132, and the short-range wireless communicator 133, and thus calibrates the time displayed on the display 160. The time calibrator 112 also calibrates the time displayed on the display 160 based on the city or time difference designated by a user through the operation receiver 150.

The DST application determiner 113 obtains DST application rule information contained in local time information stored in a local time information storage 122 of the ROM 121 of the storage 120 and DST application rule information (specific-region DST application rule information) in a specific region contained in preset information stored in a preset information storage 124 of the RAM 123. The DST application determiner 113 then determines whether to apply daylight saving time to the time displayed on the display 160 depending on whether the obtained two pieces of information match each other.

The storage 120 includes the ROM 121 composed of a non-volatile memory, such as a mask ROM, and the RAM 123 composed of a volatile memory, such as a static RAM (SRAM) or a dynamic RAM (DRAM). The storage 120 stores various types of data.

The ROM 121 stores, for example, various operational programs and setting data used for controlling the operations of the electronic timepiece 100. The ROM 121 includes the local time information storage 122 that stores local time information, in which DST application rule information determined for each region, standard-wave transmitting station information indicating each station transmitting receivable standard waves, and other information are associated with each other. The ROM 121 may also be composed of a rewritable non-volatile memory, such as an FEPROM, so that the DST application rule information can be appropriately updated in response to a change in the DST application rules in each city.

The local time information storage 122 stores, for example, a local time information table illustrated in FIG. 2 as the local time information. In the local time information table, the data items "city number", "city", "time difference", "time zone", "DST application rules", and "standard wave transmitting station" are associated with each other. The cities contained in the local time information table are different from each other in at least one of the time difference and the DST application rules.

The "city number" indicates the identification number preliminarily assigned to each city to identify the city. The "city" indicates the name of each city. The "time difference" indicates the time difference from the coordinated universal time (UTC). The "time zone" indicates each of the regions (time zones) that are generated by dividing the world map and that use mutually-different common standard times. For example, the "time zone" is represented using coordinate data (longitude and latitude) that defines the region. That is, when the location information obtained from received satellite waves is input, for example, the time calibrator 112 can obtain time difference information based on the coordinate data (longitude and latitude) indicated by the location information.

The "DST application rules" indicate rules associated with application of daylight saving time, such as a DST period of application of daylight saving time and an amount of time adjustment. The rules contain "initiation date and time" indicating the date and time of initiation of the DST period, "termination date and time" indicating the date and time of termination of the DST period, and "shifted time" indicating an amount of time to be shifted from the standard time during the DST period.

The "standard wave transmitting station" is information for identifying stations transmitting standard waves receivable in each city.

The RAM 123 serves as a work area for temporarily storing data during execution of various processes by the processor 110. The RAM 123 includes the preset information storage 124 that stores preset information that is determined in advance. The preset information contains, for example, such as city information, time difference information, specific-region DST application rule information, standard-wave transmitting station information, and location information.

The standard wave receiver 131 is equipped with a standard wave receiving module including, for example, such as a high frequency circuit, a decoder circuit, and an antenna. The standard wave receiver 131 receives standard waves to be received based on the standard-wave transmitting station information contained in the preset information stored in the preset information storage 124 of the RAM 123, demodulates the time code out (TCO) of the amplitude-modulated standard waves, extracts the time information, DST application information indicating the state of application of daylight saving time, and other information based on a time data format, and then outputs the extracted information to the processor 110. The tuning frequency of the antenna is adjusted in accordance with the carrier frequency (for example, a frequency in the low-frequency band) of the standard waves to be received under the control of the processor 110. Examples of standard waves to be received include JJY (registered trademark) in Japan, WWVB in the United States, MSF in the United Kingdom, and DCF77 in Germany.

The satellite wave receiver 132 receives satellite waves transmitted from navigation satellites, such as global positioning system (GPS) satellites and global navigation satellite system (GLONASS) satellites, demodulates and decodes the satellite waves to read navigation messages, and thus acquires necessary information. The satellite wave receiver 132 also calculates the current time and current location based on the decoding results and then outputs the calculation results to the processor 110 as time information and location information. The satellite wave receiver 132 is equipped with a module composed of a single chip including processing circuits dedicated to execution of the individual operations. This module includes a processor that controls the individual operations of the satellite wave receiver 132 and a storage device that stores setting data, data on the predicted orbits of the navigation satellites, and other data.

The short-range wireless communicator 133 is equipped with a short-range wireless communication module including, for example, such as a high frequency circuit, a decoder circuit, and an antenna. The short-range wireless communicator 133 performs short-range wireless communication with external communication devices, such as smartphones and tablets, via a communication system of, for example, such as Bluetooth (registered trademark) or Bluetooth low energy (BLE). For example, the short-range wireless communicator 133 receives time information and city number information from the external communication devices and outputs the received information to the processor 110.

The clock circuit 140 includes an oscillator circuit, a frequency dividing circuit, and a timer circuit. The clock circuit 140 determines the current time under the control of the processor 110. The oscillator circuit includes, for example, a crystal oscillator. The oscillator circuit generates a signal at a certain frequency and outputs the signal to the frequency dividing circuit. The frequency dividing circuit divides the frequency of the signal input from the oscillator circuit and outputs signals at various frequencies appropriate for use in the individual components of the electronic timepiece 100. The clock circuit determines the current date and time by counting the number of pulses of the signal input from the frequency dividing circuit and outputs the determined date and time to the processor 110. In this embodiment, the time determined by the clock circuit 140 indicates the time (local time) in a preliminarily designated city (home city).

The operation receiver 150 receives various input operations from the user and outputs electrical signals corresponding to the received operations to the processor 110. The operation receiver 150 includes, for example, a winding crown and a push-button switch. The user can designate any city or time difference through the operation receiver 150.

The display 160 includes a display screen, such as a liquid crystal display (LCD) or an organic electroluminescence (EL) display, and a display driver. The display 160 is of any one or combination of a dot matrix type and segment type and provides digital display of the date and time and various functions.

The power supply 170 supplies electric power at a certain voltage required for operations of the individual components. The power supply 170 includes batteries composed of a solar battery and a secondary battery, for example. Alternatively, the batteries may be replaced with a replaceable primary battery of a coin type or button type.

The time calibration of the electronic timepiece 100 will now be explained. In this embodiment, if receiving a user's operation of designating any city the time of which is to be displayed or any time difference, if obtaining time information retained in an external communication device via short-range wireless communication with the external communication device, or if obtaining time information through receiving satellite or standard waves, then the electronic timepiece 100 calibrates the time and appropriately updates the preset information stored in the preset information storage 124 of the RAM 123.

(Calibration of Display Time Based on Designated City)

If the user designates any city the time of which is to be displayed, the time calibrator 112 refers to the local time information stored in the local time information storage 122, and extracts the time difference information, DST application rule information, and standard-wave transmitting station information associated with the designated city. The time calibrator 112 calculates the current time of the designated city using the time determined by the clock circuit 140 based on the extracted time difference information and DST application rule information, and then causes the display 160 to display the calculated time. The time calibrator 112 also causes the preset information storage 124 to store, as the preset information, the extracted city information, city number information, time difference information, DST application rule information (specific-region DST application rule information), and standard-wave transmitting station information.

(Calibration of Display Time Based on Designated Time Difference)

If the user designates any time difference (time difference from UTC), the time calibrator 112 refers to the local time information stored in the local time information storage 122, and extracts the city information, DST application rule information, and standard-wave transmitting station information associated with the designated time difference. The time calibrator 112 calculates the current time using the time determined by the clock circuit 140 based on the designated time difference and the extracted DST application rule information, and then causes the display 160 to display the calculated time. The time calibrator 112 also causes the preset information storage 124 to store, as the preset information, the extracted city information, city number information, time difference information, DST application rule information (specific-region DST application rule information), and standard-wave transmitting station information. Specifically, the time calibrator 112 causes the preset information storage 124 to store a specific value (for example, 0xFE) indicating unspecified DST application rules as the DST application rule information, and a specific value (for example, 0xFFFC) indicating an unspecified city as the city information.

(Time Calibration Based on Time Information from External Communication Device)

If obtaining time information, city information, and time difference information via communication with an external communication device, the time calibrator 112 calibrates the time determined by the clock circuit 140 based on the obtained time information, and then causes the display 160 to display the calibrated time. The time calibrator 112 also refers to the local time information stored in the local time information storage 122, extracts the DST application rule information (specific-region DST application rule information), time difference information, and standard-wave transmitting station information associated with the city information obtained from the external communication device, and then causes the preset information storage 124 to store the extracted information as the preset information.

(Time Calibration Based on Time Information Indicated by Satellite Waves)

If time information and location information are input from the satellite wave receiver 132 receiving satellite waves, the time calibrator 112 refers to the local time information stored in the local time information storage 122, and extracts the city information, time difference information, and DST application rule information associated with the time zone to which the location indicated by the input location information belongs. The time calibrator 112 calibrates the time determined by the clock circuit 140 based on the time information and time difference information, calculates the current time using the calibrated time based on the DST application rule information, and then causes the display 160 to display the calculated time. The time calibrator 112 also causes the preset information storage 124 to store, as the preset information, the city information, location information, time difference information, and standard-wave transmitting station information. Specifically, the time calibrator 112 causes the preset information storage 124 to store a specific value (for example, 0xFFFD) indicating an unspecified city as the city information.

(Time Calibration Based on Time Information Indicated by Standard Waves)

If time information is input from the standard wave receiver 131 receiving standard waves, the time calibrator 112 calibrates the time determined by the clock circuit 140 based on the input time information. The time calibrator 112 refers to the local time information stored in the local time information storage 122, and extracts the city information, time difference information, and DST application rule information associated with the standard-wave transmitting station information indicating the station transmitting the standard waves received by the standard wave receiver 131. The time calibrator 112 also refers to the preset information stored in the preset information storage 124 and extracts specific-region DST application rule information. If the DST application rule information and the specific-region DST application rule information match each other, the time calibrator 112 applies the DST application information indicated by the standard waves to the time displayed on the display 160. If these two pieces of information do not match each other, the time calibrator 112 does not apply the DST application information indicated by the standard waves to the time displayed on the display 160. If the DST application information indicated by the standard waves is applied to the time displayed on the display 160, the time calibrator 112 causes the preset information storage 124 to store, as the preset information, the city information, time difference information, DST application rule information, and standard-wave transmitting station information.

Figure 3:
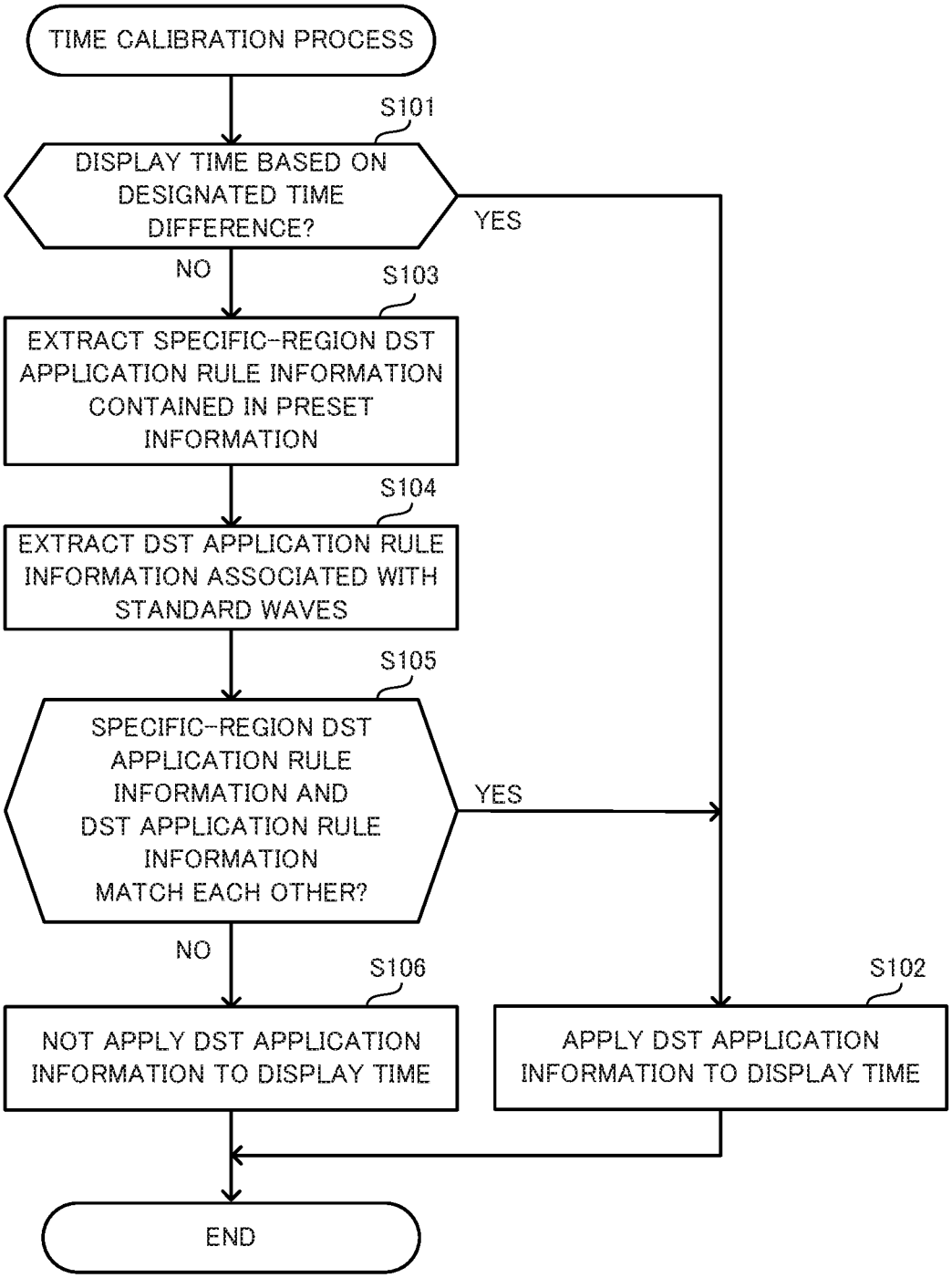
FIG. 3 is a flowchart illustrating a time calibration process.

A time calibration process executed by the processor 110 of the electronic timepiece 100 will now be explained. FIG. 3 is a flowchart illustrating an exemplary time calibration process of the electronic timepiece 100 according to the embodiment. The time calibration process is executed upon reception of standard waves in order to appropriately apply the DST application information indicated by the received standard waves to the display time. The processor 110 initiates the time calibration process in response to reception of standard waves.

After the initiation of the time calibration process, the processor 110 determines whether the display time is based on the time difference designated by a user, that is, whether the display time was calibrated in accordance with an user's operation of designating a time difference (Step S101). Specifically, the processor 110 refers to the preset information stored in the RAM 123, and then determines whether the value indicated by the city information is a specific value (for example, 0xFFFC) indicating that a city is not specified while the time difference is designated by the user's operation through the operation receiver 150. If the value indicated by the city information is the specific value (for example, 0xFFFC), the processor 110 determines that the display time is based on the time difference designated by the user. In contrast, if the value indicated by the city information is a value other than the specific value (for example, 0xFFFC), the processor 110 determines that the display time is not based on the time difference designated by the user.

If determining that the display time is based on the time difference designated by the user (Step S101: Yes), that is, if determining that the display time was calibrated in accordance with an user's operation of designating a time difference, then the processor 110 calibrates the time determined by the clock circuit 140 based on the time information indicated by the received standard waves, and applies the DST application information indicated by the standard waves to the time displayed on the display 160 (Step S102). Specifically, the processor 110 (time calibrator 112) calibrates the time determined by the clock circuit 140 based on the time information indicated by the received standard waves. The processor 110 then identifies the standard wave transmitting station that transmits the standard waves, for example, using the standard-wave call sign of the standard waves. The processor 110 (time calibrator 112) refers to the local time information stored in the local time information storage 122, and extracts the DST application rule information associated with the standard-wave transmitting station information indicating the identified standard wave transmitting station. The processor 110 applies daylight saving time to the time determined by the clock circuit 140 based on the extracted DST application rule information and the DST application information, calculates the current time, and causes the display 160 to display the calculated time. The processor 110 (time calibrator 112) also causes the preset information storage 124 to store, as the preset information, the standard-wave transmitting station information, and the city information, time difference information, and DST application rule information associated with the standard-wave transmitting station information in the local time information.

In contrast, if determining that the display time is not based on the time difference designated by the user (Step S101: No), that is, if determining that the display time was not calibrated in accordance with an user's operation of designating a time difference, then the processor 110 refers to the preset information stored in the preset information storage 124, and extracts the specific-region DST application rule information contained in the preset information (Step S103).

The processor 110 then identifies the received standard waves, and extracts the DST application rule information associated with the standard-wave transmitting station information indicating the station that transmits the identified standard waves from the local time information stored in the local time information storage 122 (Step S104).

The processor 110 (DST application determiner 113) then determines whether the specific-region DST application rule information and the DST application rule information match each other (Step S105). If determining that the specific-region DST application rule information and the DST application rule information match each other (Step S105: Yes), that is, if determining the predetermined condition to be satisfied, then the processor 110 goes to Step S102.

In contrast, if determining that the specific-region DST application rule information and the DST application rule information do not match each other (Step S105: No), that is, if determining the predetermined condition not to be satisfied, then the processor 110 calibrates the time determined by the clock circuit 140 based on the time information indicated by the received standard waves, and causes the display 160 to display the calibrated time. In other words, the processor 110 causes the display 160 to display the time determined by the clock circuit 140 without applying the DST application information indicated by the standard waves to the clock time (Step S106). After execution of Step S102 or S106, the processor 110 terminates the time calibration process.

As described above, in the electronic timepiece 100 according to the embodiment, the storage 120 stores local time information, which includes DST application rule information for each region and standard-wave transmitting station information indicating a station transmitting standard waves receivable in the region in association with each other, and stores preset information containing specific-region DST application rule information, which indicates DST application rules in a specific region. The processor 110 calibrates the time determined by the clock circuit 140 based on the time information indicated by the standard waves received by the standard wave receiver 131. The processor 110 also extracts DST application rule information associated with standard-wave transmitting station information indicating the station transmitting the standard waves received by the standard wave receiver 131 from the local time information, and controls the time displayed on the display 160 based on whether the extracted DST application rule information and the specific-region DST application rule information contained in the preset information satisfy the predetermined condition. That is, the electronic timepiece 100 can select whether to apply the DST application information indicated by the standard waves to the time displayed on the display 160. The electronic timepiece 100 can thus provide time based on appropriate application of daylight saving time.

The above-described embodiment should not be construed as limiting the disclosure and may be variously modified and applied without departing from the gist of the disclosure.

In the above-described embodiment, the operational programs executed by the CPU 111 of the processor 110 of the electronic timepiece 100 are stored in the ROM 121 in advance. This configuration, however, should not be construed as limiting the disclosure. The operational programs for execution of the above-explained various processes may also be installed in an existing general purpose computer, framework, workstation, or other device, so that the device corresponds to the electronic timepiece 100 according to the above-described embodiment.

These programs may be provided by any procedure. For example, the programs may be stored for distribution in a non-transitory computer-readable recording medium, such as a flexible disk, a compact disc read-only memory (CD-ROM), or a digital versatile disc read-only memory (DVD-ROM). Alternatively, the programs may be stored in a storage on a network, such as the Internet, and may be downloaded into a computer.

If the above-explained processes are shared by an operating system (OS) and an application program or achieved by cooperation between the OS and the application program, only the application program may be stored in a non-transitory recording medium or a storage. Alternatively, the program may be superimposed on a carrier wave and distributed via a network. For example, the program may be posted on a bulletin board system (BBS) on a network and thus delivered via the network. In this case, when activated and executed under the control of the OS as well as other application programs, the program may enable the above-explained processes to be executed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. An electronic timepiece comprising:

a storage configured to store local time information and specific-region daylight-saving-time (DST) application rule information, wherein the local time information includes DST application rule information for each region and standard-wave transmitting station information in association with each other, the standard-wave transmitting station information indicating each station transmitting standard waves receivable in the region, and the specific-region DST application rule information indicates DST application rules for a specific region;

a clock circuit configured to keep time;

a display configured to display time;

a processor configured to control clock time to be kept by the clock circuit and display time to be displayed on the display; and a standard wave receiver configured to receive the standard waves and obtain time information, wherein the processor is configured to:

calibrate the clock time based on the time information indicated by the standard waves received by the standard wave receiver;

control the display time based on whether the DST application rule information and the specific-region DST application rule information satisfy a predetermined condition; and in a case in which the DST application rule information matches the specific-region DST application rule information, determine that the predetermined condition is satisfied, and set the display time to be the same as the clock time after applying the DST application rule information to the clock time, and wherein the DST application rule information is associated with the standard-wave transmitting station information in the local time information and the standard-wave transmitting station information indicates a station transmitting the standard waves received by the standard wave receiver.

2. The electronic timepiece according to claim 1, wherein in a case in which the DST application rule information does not match the specific-region DST application rule information, the processor is configured to determine that the predetermined condition is not satisfied, and set the display time to be the same as the clock time without applying the DST application rule information to the clock time, and wherein the DST application rule information is associated with the standard-wave transmitting station information in the local time information and the standard-wave transmitting station information indicates the station transmitting the standard waves received by the standard wave receiver.

3. The electronic timepiece according to claim 2, further comprising:

an operation receiver configured to receive an operation of designating a time difference, wherein the processor is configured to set the display time to be the same as the clock time after applying the time difference received by the operation receiver to the clock time, and store, as the specific-region DST application rule information, a specific value indicating that DST application rule information corresponding to the time difference is not specified.

4. The electronic timepiece according to claim 1, further comprising:

an operation receiver configured to receive an operation of designating a time difference, wherein the processor is configured to set the display time to be the same as the clock time after applying the time difference received by the operation receiver to the clock time, and store, as the specific-region DST application rule information, a specific value indicating that DST application rule information corresponding to the time difference is not specified.

5. A control method for controlling an electronic timepiece comprising:

a storage configured to store local time information and specific-region daylight-saving-time (DST) application rule information, wherein the local time information includes DST application rule information for each region and standard-wave transmitting station information in association with each other, the standard-wave transmitting station information indicating each station transmitting standard waves receivable in the region, and the specific-region DST application rule information indicates DST application rules for a specific region;

a clock circuit configured to keep time;

a display configured to display time; and a standard wave receiver configured to receive the standard waves and obtain time information, wherein the control method comprises:

controlling clock time to be kept by the clock circuit and display time to be displayed on the display;

calibrating the clock time based on the time information indicated by the standard waves received by the standard wave receiver;

controlling the display time based on whether the DST application rule information and the specific-region DST application rule information satisfy a predetermined condition; and in a case in which the DST application rule information matches the specific-region DST application rule information, determining that the predetermined condition is satisfied, and setting the display time to be the same as the clock time after applying the DST application rule information to the clock time, wherein the DST application rule information is associated with the standard-wave transmitting station information in the local time information and the standard-wave transmitting station information indicates a station transmitting the standard waves received by the standard wave receiver.

6. A non-transitory recording medium storing a computer-readable program for controlling an electronic timepiece comprising:

a storage configured to store local time information and specific-region daylight-saving-time (DST) application rule information, wherein the local time information includes DST application rule information for each region and standard-wave transmitting station information in association with each other, the standard-wave transmitting station information indicating each station transmitting standard waves receivable in the region, and the specific-region DST application rule information indicates DST application rules for a specific region;

a clock circuit configured to keep time;

a display configured to display time; and a standard wave receiver configured to receive the standard waves and obtain time information, wherein the computer-readable program causes a computer to:

control clock time to be kept by the clock circuit and display time to be displayed on the display;

calibrate the clock time based on the time information indicated by the standard waves received by the standard wave receiver;

control the display time based on whether the DST application rule information and the specific-region DST application rule information satisfy a predetermined condition; and in a case in which the DST application rule information matches the specific-region DST application rule information, determine that the predetermined condition is satisfied, and set the display time to be the same as the clock time after applying the DST application rule information to the clock time, wherein the DST application rule information is associated with the standard-wave transmitting station information in the local time information and the standard-wave transmitting station information indicates a station transmitting the standard waves received by the standard wave receiver.

7. An electronic timepiece comprising:

a storage configured to store local time information and specific-region daylight-saving-time (DST) application rule information, wherein the local time information includes DST application rule information for each region and standard-wave transmitting station information in association with each other, the standard-wave transmitting station information indicating each station transmitting standard waves receivable in the region, and the specific-region DST application rule information indicates DST application rules for a specific region;

a clock circuit configured to keep time;

a display configured to display time;

a processor configured to control clock time to be kept by the clock circuit and display time to be displayed on the display; and a standard wave receiver configured to receive the standard waves and obtain time information, wherein the processor is configured to:

calibrate the clock time based on the time information indicated by the standard waves received by the standard wave receiver;

control the display time based on whether the DST application rule information and the specific-region DST application rule information satisfy a predetermined condition; and in a case in which the DST application rule information does not match the specific-region DST application rule information, determine that the predetermined condition is not satisfied, and set the display time to be the same as the clock time without applying the DST application rule information to the clock time; and wherein the DST application rule information is associated with the standard-wave transmitting station information in the local time information and the standard-wave transmitting station information indicates a station transmitting the standard waves received by the standard wave receiver.

* * * * *